United States Patent [19]

Lewis

[11] 3,992,767

[45] Nov. 23, 1976

[54] METHOD AND MEANS OF MULTIPLE DOWELING FOR LAMINATING CROSSTIES

[76] Inventor: Jesse M. Lewis, 6725 E. 24th, Tulsa, Okla. 74129

[22] Filed: July 10, 1975

[21] Appl. No.: 594,671

[52] U.S. Cl. ..... 29/429; 29/526; 144/1 R; 144/3 R; 144/318; 156/513; 227/27; 227/67; 227/70; 227/73; 408/42

[51] Int. Cl.[2] ..... B21D 39/03; B27F 7/02

[58] Field of Search ..... 29/200 R, 200 P, 208 R, 29/208 E, 238, 525, 526, 429; 156/513; 144/2 R, 1 R, 3 R, 92, 309 M, 313, 318, 93 R; 408/31, 42; 227/27, 67, 69, 70, 71, 73

[56] References Cited

UNITED STATES PATENTS

| | | | |
|---|---|---|---|
| 2,722,248 | 11/1955 | Anguera | 227/69 |
| 3,069,687 | 12/1962 | Fulham | 227/69 X |
| 3,099,301 | 7/1963 | Bennett | 144/318 X |
| 3,891,134 | 6/1975 | Kratsch et al. | 227/27 |

*Primary Examiner*—Othell M. Simpson
*Assistant Examiner*—W. D. Bray
*Attorney, Agent, or Firm*—Head, Johnson & Chafin

[57] ABSTRACT

Apparatus for laminating crossties comprising means for conveying a plurality of railroad crossties in substantially mutually parallel relationship onto a lifting mechanism, said lifting mechanism being operable for simultaneously moving a plurality of the crossties into a clamping apparatus wherein the crossties are securely clamped in side-by-side relation, drill means operable for drilling transversely extending bore means through said plurality of crossties, means for inserting dowel pine through said bores for securing the plurality of crossties together in a laminated arrangement and means for removing the laminated crossties from the clamped position and from the apparatus.

10 Claims, 4 Drawing Figures

METHOD AND MEANS OF MULTIPLE DOWELING FOR LAMINATING CROSSTIES

BACKGROUND OF THE INVENTION

1. Field of the Invention

This invention relates to improvements in crosstie laminating apparatus and more particularly, but not by way of limitation, to an apparatus for simultaneously inserting a plurality of dowel pins transversely through a plurality of crossties for laminating thereof.

2. Description of the Prior Art

In the laying of railroad tracks, and the like, it is considered necessary or desirable that the crossties be of certain minimum cross-sectional dimensions. In the past, lumber of sizes less than the required cross-sectional dimensions has been rejected in the making of crossties, and the crossties were constructed only from trees sufficiently large as to permit the cutting of crossties therefrom equalling at least the minimum required dimensions. As the supply of lumber has diminished in recent years, it has become necessary to be more conservative, and it is not possible to construct the required number of crossties only from sufficiently large lumber. As a consequence, it has become necessary to laminate crossties by securing a plurality of mutually parallel ties together in such a manner as to produce a single or unified construction which meets the minimum dimensional requirements.

It is common practice today to place a plurality, usually two, ties of smaller cross-sectional dimensions in side by side relation and secure them together by inserting a plurality of dowel pins, or the like, transversely therethrough. Normally, the ties are placed on a suitable conveying apparatus and moved longitudinally into a clamping and pinning apparatus. Subsequent to the pinning operation, the next succeeding crossties engage the outer end of the laminated crossties for moving the laminated crossties longitudinally away from the working area and simultaneously moving the next succeeding crossties into a position to be united. It will be readily apparent that no laminating or uniting work can be performed during the removal of the laminated ties and placement of the next succeeding ties into the working area and considering the length of the ties, and the speed of movement of the usual conveying apparatus, this normally results in a time lag in productive operation.

SUMMARY OF THE INVENTION

The present invention contemplates a novel apparatus for laminating crossties wherein a plurality of mutually parallel crossties are conveyed or transported transversely for insertion through the open side of a clamping apparatus. The multiple number of crossties are securely clamped in the clamping apparatus whereby a plurality of transverse bores may be simultaneously drilled through the side-by-side crossties. As the drills are withdrawn from the bores, dowel pins are inserted therethrough in a press fit for securely uniting or laminating the multiple ties to provide a unified crossties structure meeting the required cross-sectional dimensions. Subsequent to the laminating of a crossties the next succeeding multiple number of side-by-side ties are moved transversely into the open side of the clamping apparatus and brought into engagement with the laminated crosstie clamped therein. The laminated crosstie may then be unclamped and a continued transverse movement of the next succeeding ties moves the completed crosstie out of the clamping area in a transverse direction. As soon as the next succeeding ties are positioned properly in the clamping apparatus, they may be securely clamped therein and the drilling and doweling operation commenced as before. While the next succeeding ties are being laminated, the completed or laminated tie may be moved longitudinally out of the clamping apparatus and onto a suitable conveying apparatus for transport to storage, or for use, as desired, and as well known. It will be readily apparent that a completed cross-tie is moved only a relatively short distance before the next laminating operation may be commenced, thus greatly increasing the efficiency and reducing the cost of the laminating operation.

DESCRIPTION OF THE PREFERRED EMBODIMENT

Figure 1:
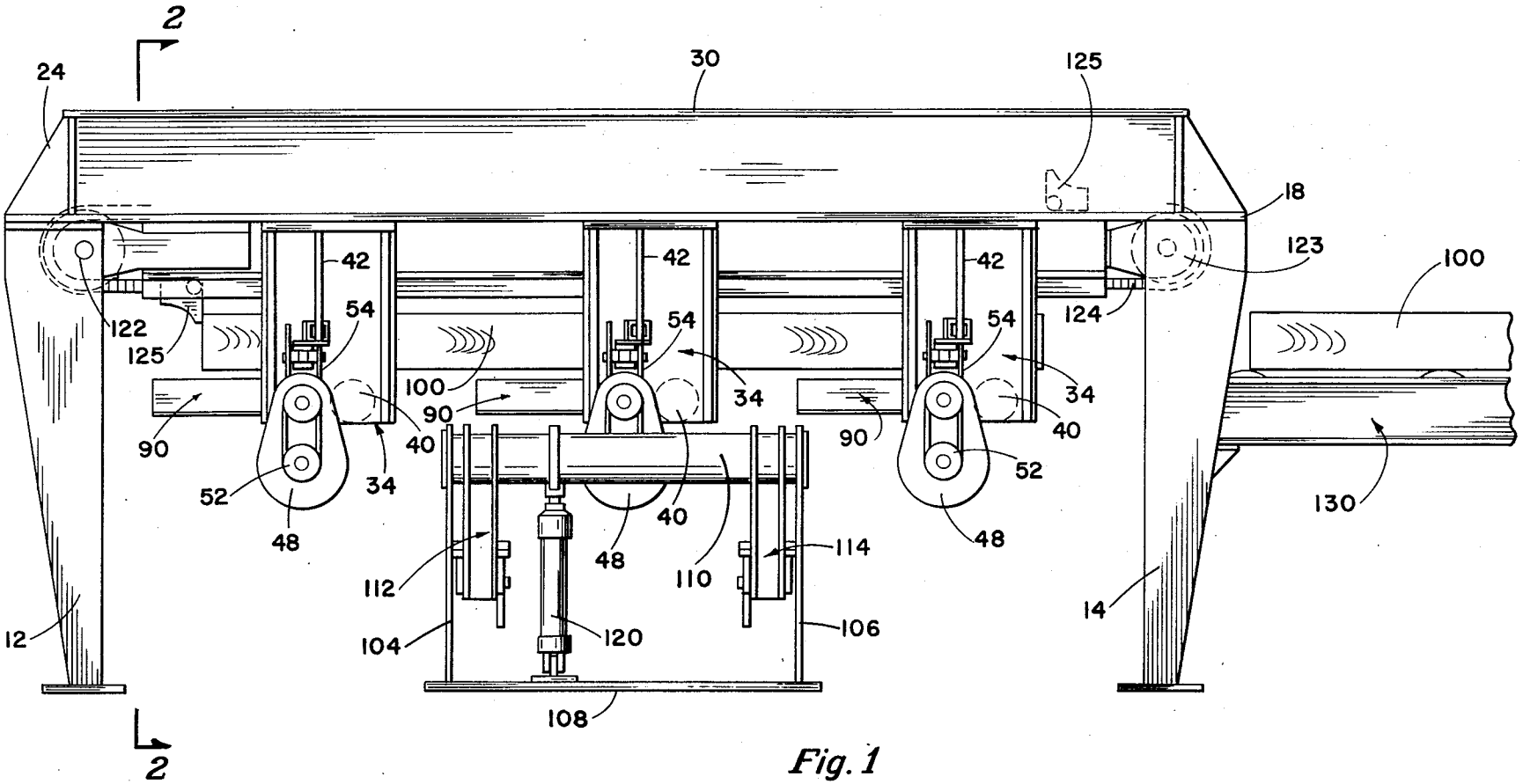
FIG. 1 is an end elevational view of a multiple doweling apparatus embodying the invention.
Figure 2:
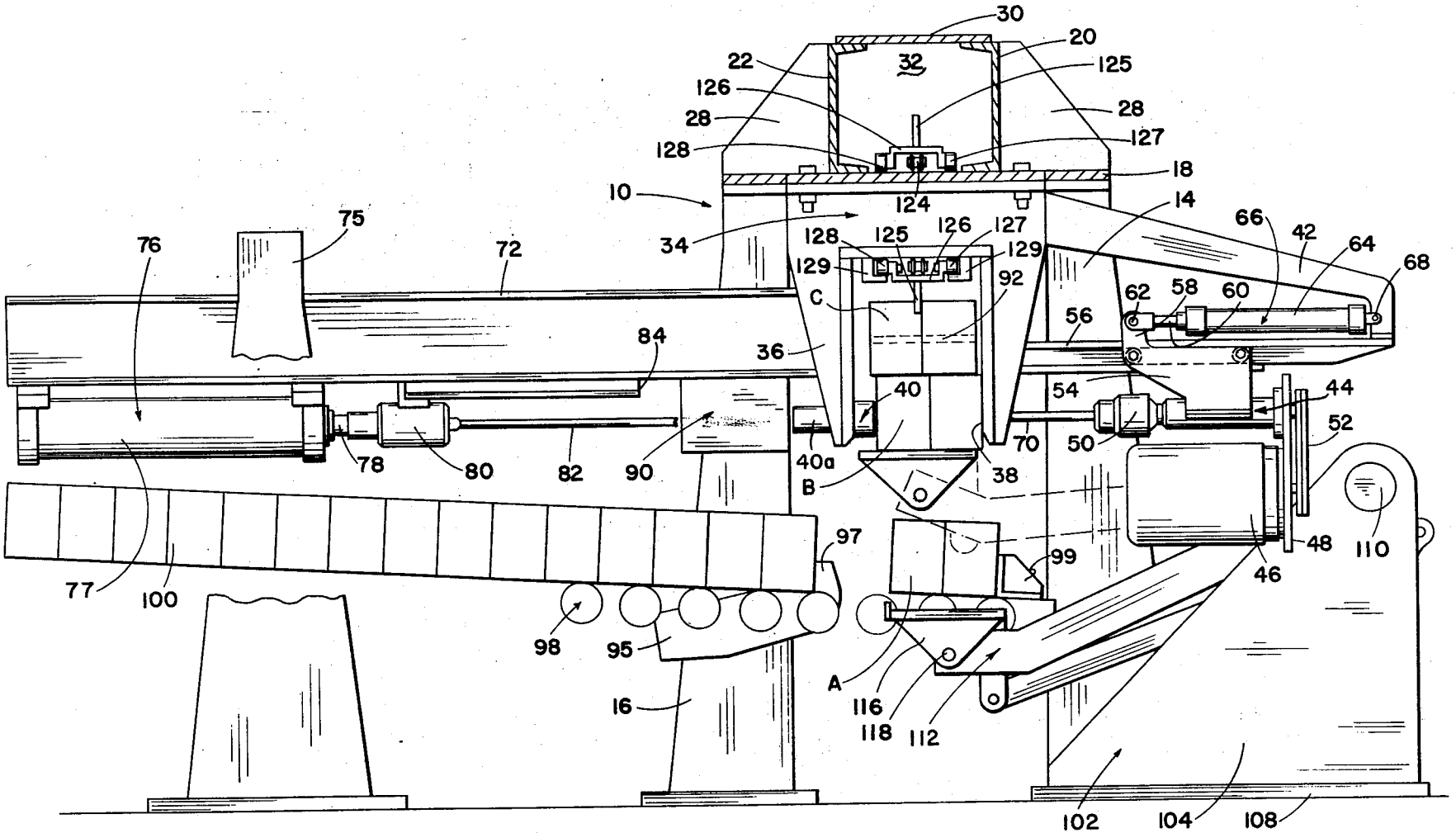
FIG. 2 is a sectional elevational view taken on line 2—2 of FIG. 1 and depicts a laminated crosstie in one position, a plurality of ties in the clamped operational area and a plurality of ties in a position for being moved into the clamped operational area.
Figure 3:
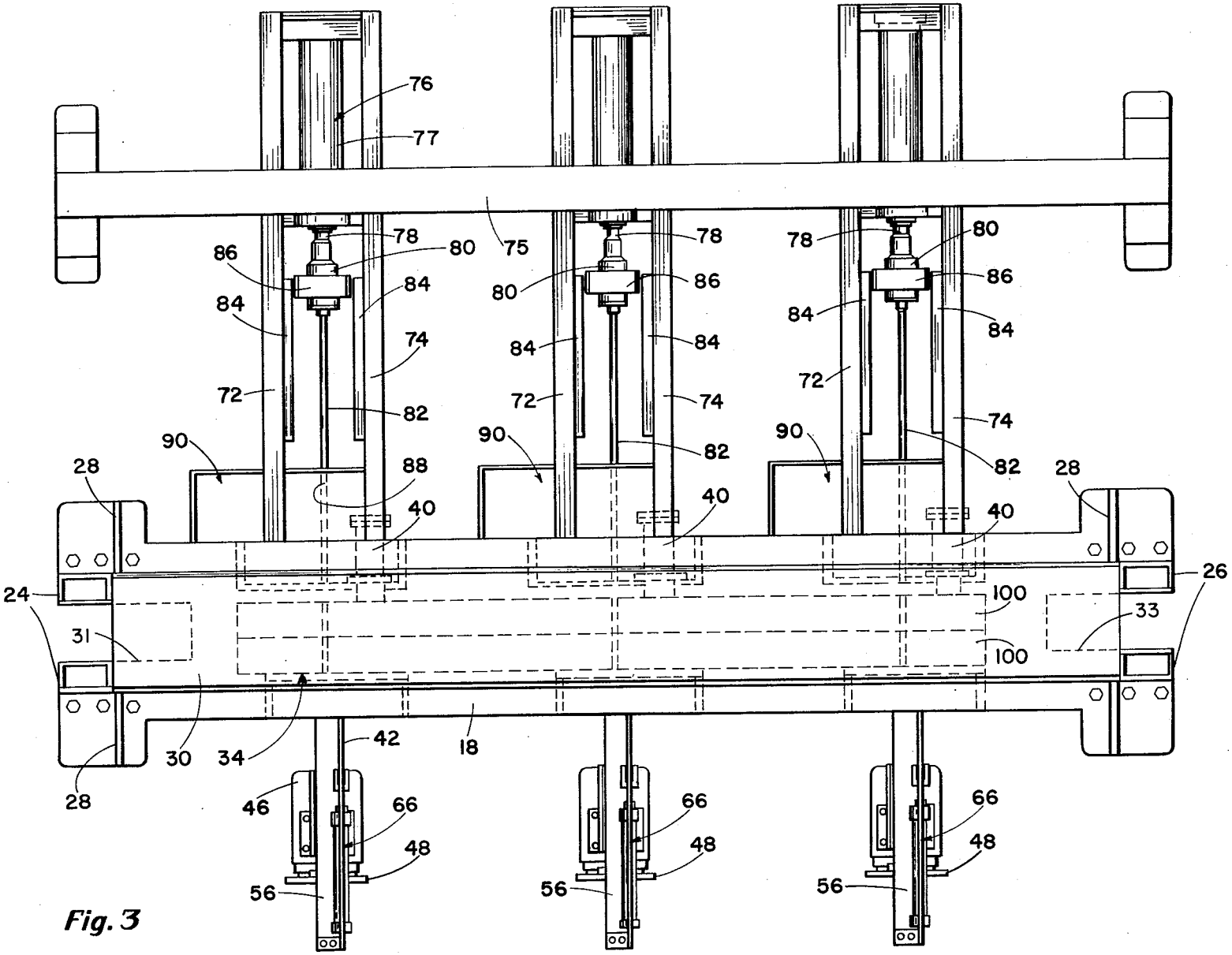
FIG. 3 is a plan view of a multiple doweling apparatus embodying the invention.
Figure 4:
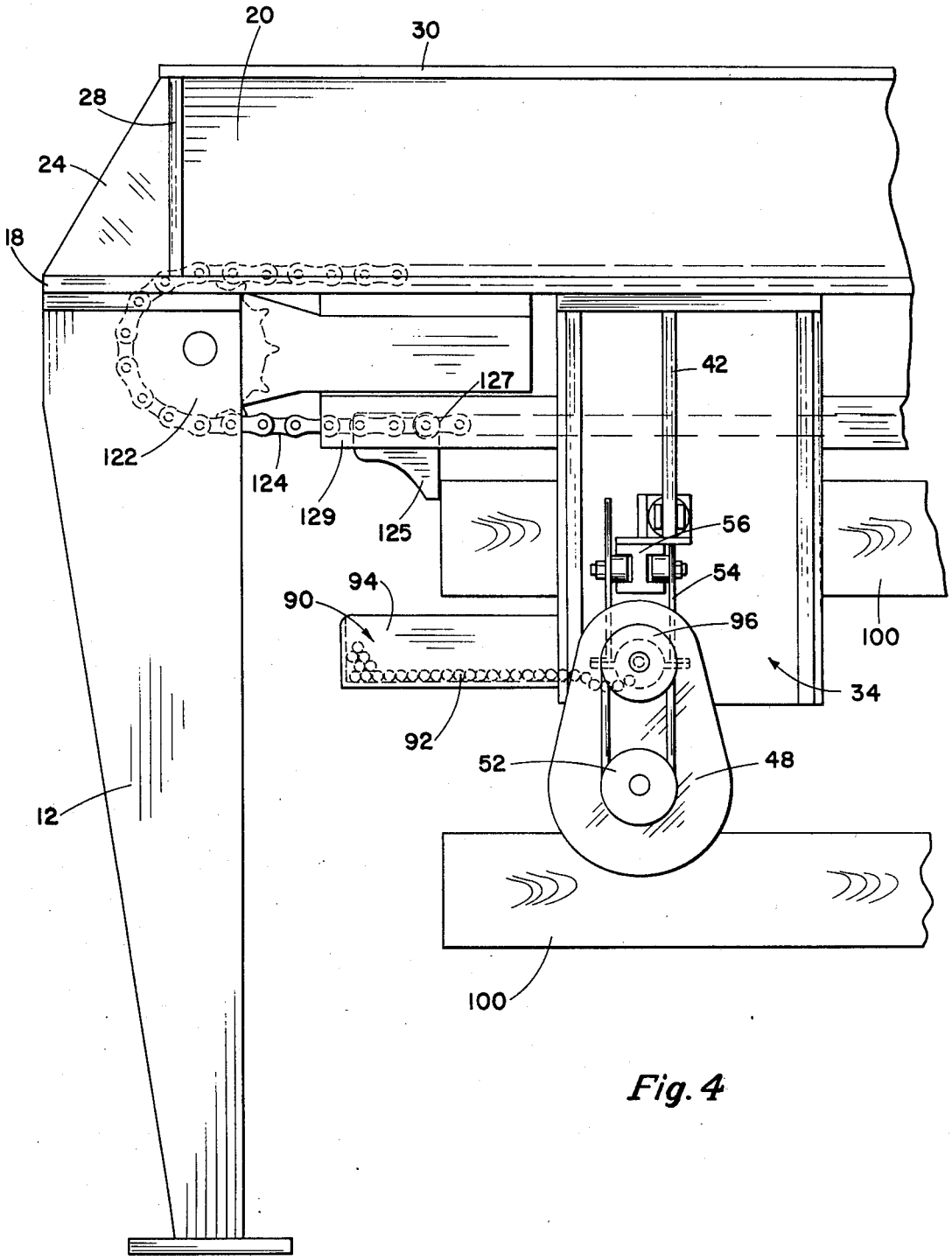
FIG. 4 is an enlarged end elevational view of the leading portion of a multiple doweling apparatus embodying the invention.

Referring to the drawings in detail, reference character 10 generally indicates a multiple doweling apparatus comprising a first pair of longitudinally spaced support leg members 12 and 14, and a second pair of substantially identical support leg members 16 (only one of which is shown in FIG. 2) transversely spaced therefrom and in substantial alignment therewith. A plate member 18 is secured to the upper end of the legs 12, 14 and 16 if any suitable manner, such as by welding or the like, and spans the distance therebetween as particularly shown in FIGS. 1 and 2. A pair of oppositely disposed longitudinally extending channel members 20 and 22 are welded or otherwise secured to the upper surface of the plate 18 and extend substantially throughout the length thereof. If desired, suitable end channels 24 and 26 may be welded or the like to the opposite ends of the channels 20 and 22, and strengthening webs 28 may be bolted, or otherwise secured between the plate 18 and the channels 20 and 22, if desired, as is well known. In addition, a cover plate 30 is welded or otherwise secured along the upper edges of the channels 20 and 22 for spanning the distance therebetween and enclosing a chamber 32 therebetween. The opposite ends of the plate 18 are provided with longitudinally extending centrally disposed slots or recesses 31 and 33 for a purpose as will be hereinafter set forth.

A plurality of substantially identical C-clamp members generally indicated at 34 are provided for the apparatus 10, and whereas three clamps 34 are shown bolted or otherwise secured to the plate 18 in longitudinally spaced relation between the legs 12, 14 and 16, it will be apparent that substantially any number of the clamps 34 may be provided for the apparatus 10. Each C-clamp 34 comprises substantially U-shaped or C-shaped elements 36 having at least one open end or side 38. A clamping bar 40 is movably secured to one leg of the C-shaped element 36 and is transversely movable with respect thereto in any suitable manner (not shown) for a purpose as will be hereinafter set forth.

Each C-shaped element 36 is provided with an outwardly extending mounting bracket 42 welded or otherwise rigidly secured thereto for supporting a drilling unit generally indicated at 44. The drilling unit 44 may be of any suitable type and as shown herein comprises a motor 46 mounted on a plate 48 in any well known manner (not shown) and in driving communication with a drill press apparatus 50 through a belt and pulley drive mechanism 52. The drill press apparatus 50 is carried by a bracket 54 which is slidably mounted on a rail or track member 56 that is preferably an integral part of the mounting bracket 42 and extends substantially horizontally from the C-shaped element 36, as particularly shown in FIG. 2. The bracket 54 is provided with an upwardly extending flange member 58 having one end of a piston rod 60 pivotally secured thereto at 62. The piston rod 60 is slidably disposed within the cylindrical housing 64 of a suitably hydraulic cylinder unit 66. The outer end of the housing 64 is pivotally secured to the bracket 42 at 68 and alternate extension and contraction of the piston rod 60 with respect to the housing 64 reciprocates the bracket 54 along the track or rail 56 in order to move the drill bit 70 of the drilling unit 44 in alternate directions toward and away from the C-shaped element 36 for a purpose as will be hereinafter set forth. Of course, the drill bit 70 is disposed in substantial axial alignment with a transversely extending bore (not shown) provided in the C-shaped element 38 and as the drill bit 70 is moved in said directions toward and away from the C-shaped element 36, the drill bit 70 slides or reciprocates within the transverse bore.

A pair of substantially identical oppositely disposed support channels 72 and 74 are welded or otherwise rigidly secured to each C-shaped element 36 and extend substantially horizonally therefrom in an opposite direction with respect to the drilling unit 44. The channels 72 and 74 are preferably supported in the proximity of the outer ends thereof by a suitable support frame 75 in any well known manner. A suitable hydraulic cylinder 76, or the like, is carried by the channels 72 and 74 and is provided with the usual cylinder housing 77 and reciprocal piston rod 78. An individual ramming apparatus generally indicated at 80 is carried by the rod 78 and includes a ramming rod 82 projecting outwardly therefrom in a direction toward the C-shaped element 36. In addition, the ramming apparatus 80 is movably or slidably supported by the respective channels 72 and 74 by means of guide channels or rails 84 depending from the channels 72 and 74 and a complementary slide element 86 suitably secured to the ramming apparatus 80 and slidably engagable with the rails 84. The ramming rod 82 is disposed in substantial alignment with a transverse bore (not shown) provided in the C-shaped element 36, and extends slidably through a bore 88 provided in a dowel pin housing 90 for a purpose and in a manner as will be hereinafter set forth.

The dowel pin housing 90 may be of any suitable type for delivering individual dowel pins 92 into substantial alignment with the ramming rod 82 and as shown herein comprises a storage area 94 for storing a plurality of the dowel pins 92 in substantially parallel relationship to the axis of the ramming rod 82. Rotatable dowel pin receiving means 96 is in open communication with the storage area 94 for receiving the dowel pins 92 individually and sequentially therein whereby each pin 92 may be moved into axial alignment with the ramming rod 82 during a lamination operation as will be hereinafter set forth.

A suitable conveying apparatus generally indicated at 98 in FIG. 2 is disposed in the proximity of the channels 72 and 74 and preferably extends substantially perpendicularly from the place established by the legs 12 and 14. A pivotal arm 95 is provided on the conveying apparatus 98 in the proximity of the legs 16 and has an outwardly projecting flange 97 which functions as a first stop member. A second or terminal stop member 99 is provided on the conveying apparatus 98 in spaced relationship to the stop member 97. A plurality of crossties 100 may be deposited in side-by-side, mutually parallel relationship on the conveying apparatus 98 for being conveyed therealong into a position wherein the leading crosstie is engaged by the stop member 97. When it is desired to laminate a plurality of the ties 100, for example two adjacent ties 100, the pivotal arm 95 may be actuated in any well known manner whereby the leading two ties 100 on the conveying apparatus 98 will be moved to a position beyond the step 95, whereupon the pivotal arm 95 will be repositioned for retaining the succeeding ties 100 behind the stop 97. The two ties 100 which have thus been released by the arm 95 are conveyed or moved into a position wherein the leading tie of the two is in engagement with the final stop member 99. In this position the two ties 100 will be disposed in substantial alignment with the open ends 38 of the C-shaped elements 36.

A lifting apparatus generally indicated at 102 is provided for receiving multiple members of the crossties 100 thereon from the conveying apparatus 98, such as the two ties 100 positioned in alignment with the open ends 38, in a manner and for a purpose as will be hereinafter set forth. The lifting apparatus 102 may be of any suitable type and as depicted herein comprises a pair of spaced upright side plates or sidewalls 104 and 106 suitably secured to a base plate 108 and having a pivot shaft 110 journalled therebetween. A plurality of lift arms 112 and 114 are rigidly secured on the pivot shaft 110 for rotation simultaneously therewith about the longitudinal axis thereof whereby the arms 112 and 114 are rotated in a substantially vertical plane. Alternately, the arms 112 and 114 may be suitably journalled on the pivot shaft 110 for rotation independently with respect thereto. In addition, it is preferable to provide two of the arms 112 and 114 as shown herein with the arms 112 and 114 being spaced for transversely spanning the conveying apparatus 98. Each arm 112 and 114 is provided with a load receiving head 116 pivotally secured at 118 to the outer extremity thereof. The load receiving heads 116 are preferably so constructed as to maintain a substantially horizontal position for the upper surface thereof at all angular positions of the arms 112 and 114. A suitable hydraulic lifting cylinder 120 may be anchored between the base 108 and the pivot shaft 110 in any suitable manner for selectively transmitting rotation to the pivot shaft 110 and arms 112 and 114.

A pair of suitable sprocket members 122 and 123 are journalled within the slots 34 and 36, respectively, of the plate 18 in any well known manner and are in substantial planar alignment for receiving an endless belt or chain 124 therearound. The plane of the sprocket members 122 and 123 is substantially perpendicular to the plane of the plate 18 and the chain 124 travels on opposite sides of the plate 18 during rotation of the sprockets 122 and 123. A plurality of outwardly extending lug members 125 are secured to the chain 124 by suitable link members 126 (FIG. 2) and are longitudinally spaced therealong for a purpose as will be hereinafter set forth. Roller members 127 and 128 are journalled on the opposite ends of each link member 126 and as the link members 126 are moving along the upper surface of the plate 18 the rollers 127 and 128 may roll directly on the plate 18. However, as the links 126 are passing beneath the plate 18 it is preferable to provide suitable oppositely disposed rails or tracks 129 secured to the plate 18 for rollingly receiving the rollers 127 and 128 thereon.

The clamping cylinder 40 may be of any suitable type. For example, a spring urged movable piston or sleeve (not shown) may be slidably disposed within the outer housing 40*a*, and constantly urged axially outward in a direction toward the opposite side of the C-shaped element 36. The piston is thus yieldably retained in clamping engagement with substantially any article being clamped in the C-clamp apparatus 34, regardless of the size thereof.

A second conveying apparatus, generally indicated at 130 in FIG. 1, is suitably secured between the leg 14 and the complementary leg 16 and extends from the legs 14 and 16 in a direction substantially parallel to the direction of travel of the chain 126 and in a direction away from the clamping members 34.

In operation, a plurality of crossties 110 of varying cross-sectional dimensions may be disposed on the first conveyor apparatus 98 in the usual manner, with the ties being placed mutually parallel and in substantial parallel relationship to the longitudinal dimension of the apparatus 10. The desired number of ties 110, preferably two as shown in FIG. 2, but not limited thereto, are released from engagement by the first step member 97 and are moved into a terminal position on the conveying apparatus 98 as limited by the step 99 and as shown at A in FIG. 2.

The hydraulic cylinder 120 may then be actuated for rotating the arms 112 and 114 in a direction for elevating the crossties 100 carried by the load head 116 upwardly through the open end 38 of the C-shaped element 36 and into a clamping position B therein. The clamping member 40 may then be actuated or utilized for securely clamping the ties 100 in the C-shaped element 36. The drilling apparatus 50 may then be activated for moving the drill bit 70 substantially horizontally through the crossties 100 clamped in the element 36. As soon as the drill 70 has completely transversely penetrated the clamped crossties 100 the drill 70 may be reversed and backed off in the usual manner. Of course, it is preferable to actuate all of the drilling devices 50 simultaneously, but not limited thereto.

When the drill or drills 70 begin to retreat or move out of the drilled bores in the clamped crossties 100, a dowel pin 92 is moved into substantial axial alignment with the transverse bore of the clamped crossties 100, and the ramming apparatus 80 is activated for inserting a pin 92 completely through each of said bores. It will be apparent that the insertion of the dowel pins may be initiated prior to the complete removal of the drill or drills 70 from the respective bores, thus providing an efficient and time saving operation.

During the drilling and doweling operations of the clamped crossties 100, the hydraulic cylinder 120 may be actuated for moving the arms 112 and 114 in an opposite direction into a load receiving position. The conveying apparatus 98 may be utilized as hereinbefore set forth for depositing another group of crossties 100 on the loading head 116, whereupon the arms 112 and 114 may again be elevated to a position wherein the newly loaded crossties thereon will be in engagement with the lower sides of the clamped crossties 100. Subsequent to the doweling of the clamped crossties 100, the clamping pressure of the element 40 may be relieved sufficiently whereby a continued upward movement of the arms 112 and 114 will lift the doweled crossties 100 from the clamped position and replace the completed or laminated crossties with the newly loaded crossties. It will be apparent that this action will elevate the doweled or laminated crossties to a position above the clamped crossties as particularly shown as C in FIG. 2. The laminated crosstie 100 will be freely disposed above the crossties in position B and as the chain 124 moves between the sprockets 122 and 123, one of the lugs 125 will engage the end of the free laminated crosstie for easily moving the crosstie longitudinally along the upper edge of the clamped crossties in position B. The free laminated crosstie will be moved onto the second conveying apparatus 130 for transport to storage or the like.

It will be apparent that the lift arms 112 and 114 are picking up additional crossties to the laminated at the same time the clamped crossties in position B are being laminated and the laminated crosstie in position C is being removed from the apparatus 10 during the laminating operation of crossties in position B. The laminated crosstie 100 is moved through only a relatively short distance substantially equal to the width of the next succeeding crosstie subsequent to a doweling operation and prior to the beginning of the next succeeding operation. Thus, very little time is lost during the sequential operation of laminating multiple numbers of crossties.

Whereas the particular embodiment depicted herein illustrates the clamping apparatus 34 as having a C-shaped element 36 with the open end 38 thereof facing downwardly, it is to be understood that the open end 38 may extend laterally or upwardly, as desired. The important feature is the lateral movement of crossties into and out of the clamping apparatus as opposed to any longitudinal movement of the crossties into and out of the clamping apparatus.

From the foregoing it will be apparent that the present invention provides a novel multiple doweler for laminating crossties wherein a substantially continuous doweling or laminating operation is provided for the sequential doweling or laminating of crossties. The apparatus comprises a C-clamp type clamping apparatus for laterally receiving multiple numbers of crossties therein. One set of crossties may be doweled or laminated simultaneously with the removal of the preceding completed or laminated crossties and simultaneously with the loading and elevating of the next succeeding crossties. Thus, a plurality of laminated crossties may be constructed with a minimum of time and expense.

Whereas the present invention has been described in particular relation to the drawings attached hereto, it should be understood that other and further modifications, apart from those shown or suggested herein, may be made within the spirit and scope of this invention.

What is claimed is:

1. A multiple doweler apparatus for laminating crossties comprising means for conveying multiple numbers of crossties in mutually parallel relationship for lateral insertion thereof into a clamping apparatus, clamping means provided for said clamping apparatus for intermittently retaining selected numbers of the crossties within said clamping apparatus, drilling means operable for drilling transversely extending bores through said clamped selected number of crossties, dowel pin storage means, ramming means cooperating with said dowel pin storage means and operable for inserting individual dowel pins through each of said transverse bores for securing said selected number of crossties together to provide a single laminated crosstie and means for removing said laminated crosstie from the clamping apparatus subsequent to the doweling thereof.

2. A multiple doweler apparatus as set forth in claim 1 wherein the first mentioned means comprises conveying means for transporting a plurality of the crossties into the proximity of said clamping apparatus and means for removing said selected number of ties from said conveying apparatus and inserting thereof laterally into said clamping apparatus.

3. A multiple doweler apparatus as set forth in claim 2 wherein the removing means comprises a plurality of lifting arms rotatable in a substantially vertical plane and load head means pivotally secured to the outer extremity of said lifting arms for engaging and supporting said selected number of crossties.

4. A multiple doweler apparatus as set forth in claim 1 wherein the clamping means comprises a C-clamp element having one side thereof open for receiving said selected number of crossties therethrough.

5. A multiple doweler apparatus as set forth in claim 1 wherein said clamping means comprises a C-clamp element having the lower end thereof open for receiving said selected number of crossties therethrough and independent clamp member carried by the C-clamp element for clamping the crossties therein regardless of the transverse dimension thereof.

6. A multiple doweler apparatus as set forth in claim 1 wherein the drilling means includes support arm means secured to the clamping apparatus, drill press means, guide bracket means secured to the drill press means and slidably engageable with the support arm means to provide horizontal reciprocal movement for the drill press means and power supply means operably connected with the drill press means.

7. A multiple doweler apparatus as set forth in claim 1 wherein the drilling means comprises a plurality of spaced drill press means and means securing each drill press means to the clamping apparatus for horizontal reciprocal movement with respect thereto.

8. A multiple doweler apparatus as set forth in claim 1 wherein the means for removing said selected number of crossties from the clamping apparatus comprises sprocket means journalled on the clamping apparatus, endless chain means extending around the sprocket means and movable thereby in a longitudinal direction with respect to said selected number of crossties, outwardly extending lug means carried by the chain means and movable simultaneously therewith, said lug means being engagable with one end of said laminated crosstie for moving said laminated crosstie longitudinally out of said clamping apparatus.

9. A method of laminating a plurality of crossties comprising conveying a plurality of mutually parallel crossties to the proximity of a clamping apparatus, moving a selected number of the crossties laterally into the clamping apparatus, clamping said selected number of crossties clamping apparatus, clamping mutually parallel relationship, drilling at least one continuous transverse bore through said selected number of crossties, inserting an individual dowel pin through each transverse bore to provide a laminated crosstie, releasing the clamping engagement of the laminated crosstie, removing said laminated crosstie from the clamped position simultaneously with the position of a next succeeding selected number of crossties in said clamping position and removing the laminated crosstie from the clamping apparatus simultaneously with the drilling and doweling operation of said next succeeding selected number of crossties.

10. A method as set forth in claim 9 wherein the laminated crosstie is removed from the clamping apparatus in a longitudinal direction.

* * * * *